US005739528A

United States Patent [19]

Kato

[11] Patent Number: 5,739,528

[45] Date of Patent: Apr. 14, 1998

[54] FAST ATOM BEAM SOURCE

[75] Inventor: Takao Kato, Tokyo, Japan

[73] Assignee: Ebara Corporation, Tokyo, Japan

[21] Appl. No.: 752,439

[22] Filed: Nov. 14, 1996

[30] Foreign Application Priority Data

Nov. 17, 1995 [JP] Japan ..... 7-323802

[51] Int. Cl.[6] ..... H05H 3/00

[52] U.S. Cl. ..... 250/251

[58] Field of Search ..... 250/251, 305, 250/306, 307, 492.1, 492.2

[56] References Cited

U.S. PATENT DOCUMENTS

| | | | |
|---|---|---|---|
| 3,300,640 | 1/1967 | Eubank | 250/251 |
| 3,757,114 | 9/1973 | Simms et al. | 250/251 |
| 3,767,925 | 10/1973 | Foley, Jr. et al. | 250/251 |
| 3,790,411 | 2/1974 | Simms et al. | 250/251 |
| 4,037,102 | 7/1977 | Hoyle et al. | 250/251 |
| 4,377,773 | 3/1983 | Herschcovitch et al. | 315/111.81 |
| 5,243,189 | 9/1993 | Nagai et l. | 250/251 |

FOREIGN PATENT DOCUMENTS

| | | |
|---|---|---|
| 61-86698 | 5/1986 | Japan . |
| 61-86699 | 5/1986 | Japan . |
| 62-237699 | 10/1987 | Japan . |
| 63-43248 | 2/1988 | Japan . |

OTHER PUBLICATIONS

Journal of Vacuum Science and Technology: Part A, *A scanned microfocused neutral beam for use in secondry ion mass spectrometry*, vol. 4, 1986, figs. 1A–1B.

Patent Abstracts of Japan, vol. 13, No. 097 (E–723), Mar. 7, 1989, abstract of JP 63 271855A (Toshiba Corp) Nov. 9, 1988.

Musashi Institute of Technology et al., "Trail of Focused Atom Beam Source", Extended Abstracts (The 56th Autumn Metting, 1995), The Japan Society of Applied Physics, Japan, 1995, p. 483.

A. J. Eccles et al., "A scanned microfocused neutral beam for use in secondary ion mass spectrometry", American Vacuum Society, 1986, pp. 1888–1892.

Kazuyoshi Kagai et al, A Fab–Sims/Sinms Appratus, Nuclear Instruments and Method in Physics Research, Elsevier Science, Publishers B.V, Amsterdam, 1988, pp. 486–488.

Kazuyoshi Nagai et al., "A Focused Fast Atom Beam Bombardment Sims", Japan Society for the Promotion of Society, 1986, pp. 36–40.

*Primary Examiner*—Michael J. Tokar
*Assistant Examiner*—Kiet T. Nguyen
*Attorney, Agent, or Firm*—Wenderoth, Lind & Ponack

[57] ABSTRACT

A fast atom beam source which can efficiently provide a fast atom beam having a diameter less than 1 μm. The fast atom beam source has an ion source for ionizing a liquid metal to generate metal ions, a control electrode system for controlling the flux of metal ions, and a neutralizing chamber in which the ion beam is neutralized to generate a fast atom beam. The neutralizing chamber is disposed in a path of the ion flux. A neutralizing gas supply supplies a neutralizing gas into the neutralizing chamber, the neutralizing gas containing a metal element.

38 Claims, 9 Drawing Sheets

FAST ATOM BEAM SOURCE

BACKGROUND OF THE INVENTION

1. Field of the Invention

The present invention relates to a fast atom beam source for generating an electrically neutral microbeam, more particularly for a fast atom beam source to generating an electrically neutral fast atom beam having a beam diameter on a submicron order.

2. Description of the Related Art

A mass spectrometry of ions emitted from a sample that is bombarded by an ion beam is used for determining a component of the sample or the amount of impurities contained in the sample. This method, known as SIMS (Secondary Ion Mass Spectrometry), is widely used in the development of semiconductors or other new materials, and is one of the most sensitive analytical methods for a surface of the sample. However, the ion beam used in this method, when irradiated on insulating samples, may possibly cause analytical difficulty due to beam deflection or damage of the sample by discharge resulting from a charging-up on the sample.

When a fast atomic beam of a submicron order is used instead of the ion beam in the method, the charging-up on the surface of the sample does not occur since the fast atom beam does not have any electrical charges. Thus, the use of the fast atomic beam in this method makes it easy to analyze insulators such as ceramics, plastics and organic compounds and makes it possible for SIMS to exhibit its power in the characterization of various materials.

Also, the use of the fast atom beam as a primary beam in microprocessing or microfabrication makes it possible to microscopically process insulators such as ceramics, plastics, organic compounds, or biological tissues, which have been difficult to process on a submicron order.

The method for generating an electrically neutral microbeam is a relatively new technique and is not perfectly completed yet. Therefore, there is only a limited number of publications disclosing such methods. One of these is "A scanned microfocused neutral beam for use in secondary ion mass spectrometry", A. J. Eccles, J. A. van den Berg, A. Brown and J. C. Vickerman, J. Vac. Sci. Technol. A4, 1888 (1988). In the above publication, gas ions which are extracted from a plasma-type ion source are neutralized to obtain an electrically neutral microbeam having a diameter of approximately 5 microns.

However, the diameter of the fast atom beam of the prior art is larger than expected, and is not useful for the purpose of a precise analysis or processing. The background for that is as follows. There has been an attempt to generate a neutral beam having a large diameter with a large amount of electric current for adding energy to a nuclear fusion system. However, there have been few attempts to generate a fast atom beam having a small diameter. Since it is difficult to control a neutralized beam, in order to provide an electrically neutral beam having a small diameter, firstly an ion beam of a small diameter is provided and then the ion beam is neutralized. However, it is difficult to efficiently neutralize the ion beam having a small diameter since a crossing region between the ion beam and a neutralizing agent is small.

SUMMARY OF THE INVENTION

It is therefore an object of the present invention to provide a fast atom beam source which can efficiently provide a fast atom beam having a diameter less than 1 μm.

According to a first aspect of the present invention, there is provided a fast atom beam source for generating an electrically neutral fast atom beam, which includes an ion source for ionizing a liquid metal to generate metal ions, a control electrode system for controlling the flux of the metal ions, a neutralizing chamber disposed in a path of the ion flux for neutralizing the ions in the ion flux to generate a fast atom beam, and a neutralizing gas supply for supplying a neutralizing gas into the neutralizing chamber, the neutralizing gas containing a metal element.

The ions emitted from the ion source have a source size(diameter) as small as several tens of nanometers. The flux of the ions is controlled by adjusting the size or focusing condition with the control electrode system so as to conform the flux to the usage of the beam. After that, the ion beam is efficiently neutralized in the neutralizing chamber containing a metal element in the atmosphere, and then irradiated on to the sample. The control electrode system may include a condenser lens, an alignment electrode, a stigmator, a blanking electrode, an objective aperture, an objective lens, and a deflection electrode.

When the metal contained in the neutralizing gas is of the same group as the liquid metal, the ion beam is more efficiently neutralized as compared to a combination of different group elements. Especially when the metal contained in the neutralizing gas is the same element as the liquid metal, a much higher neutralization efficiency may be achieved.

In the above invention, the metal element in the neutralizing gas may be in a form of a metal vapor or an organometal gas.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENT

Figure 1:
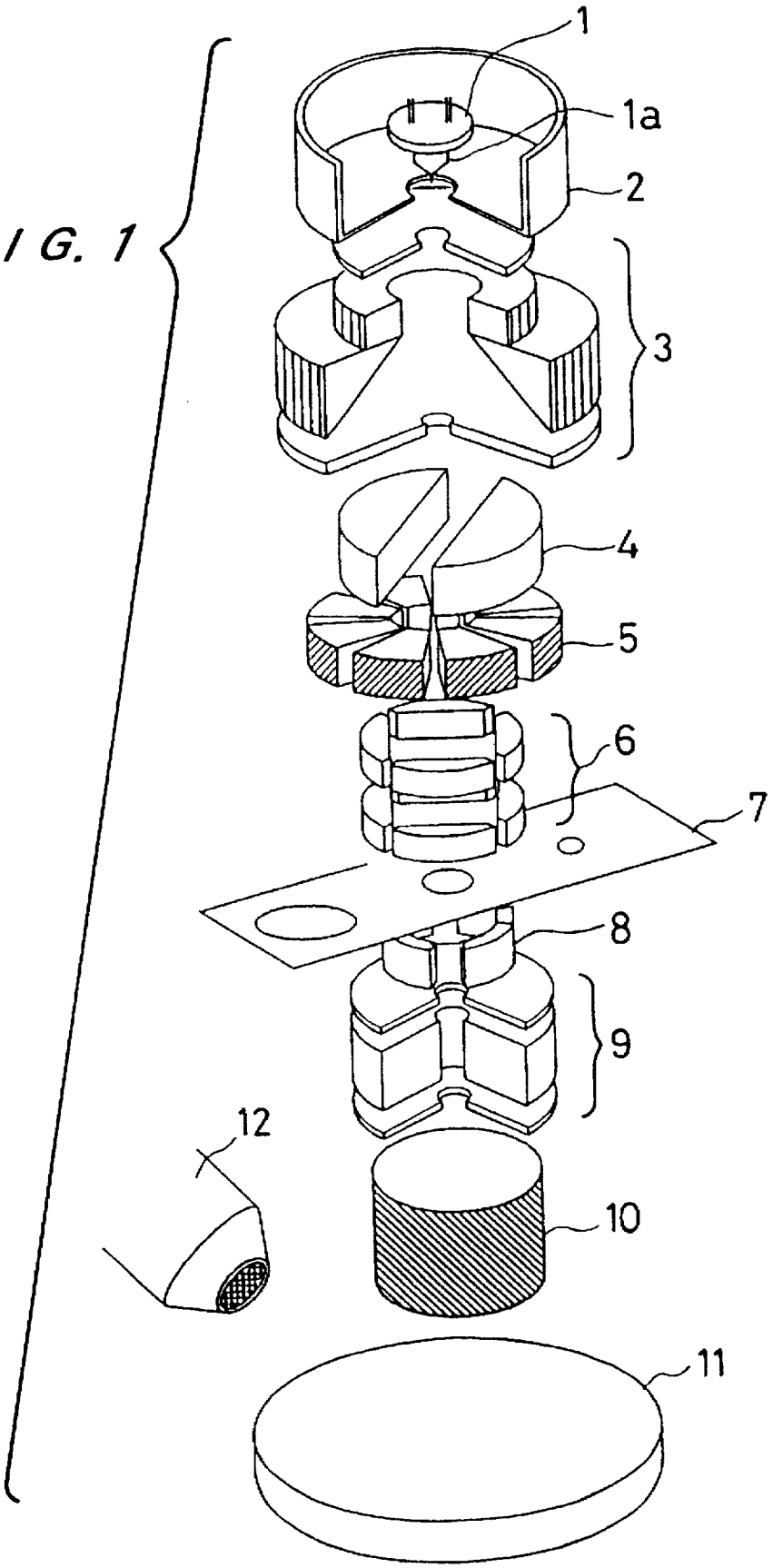
FIG. 1 is a perspective view showing an example of a fast atom beam source of the present invention.

Hereinafter, preferred embodiments of the present invention will now be described in detail. In the following description, it should be noted that the same or similar features are denoted by the same reference numerals.

FIG. 1 shows an embodiment of a fast atom beam source of the present invention. The fast atom beam source of the present invention comprises a liquid metal ion source 1 which has a heater 1*a* therein. An extraction electrode 2 is for emitting an ion beam from the ion source 1 due to field emission. A condenser lens 3 controls the ion beam current by changing an angle of incidence of the ion beam incident on an objective aperture 7. A blanking electrode 4 deflects the ion beam suspending beam irradiation. A stigmator 5 corrects astigmatism due to a non-circular cross-section of the ion beam. A alignment electrode 6 passes the ion beam to a small objective aperture 7. A deflecting electrode 8 raster-scans the ion beam. An objective lens 9 focuses an ion beam on the sample, a neutralizer 10, the sample through being placed on a sample stage 11. All of the above are aligned. Above the sample stage 11 is provided a secondary electron multiplier 12 for collecting secondary electrons emitted from the sample. The fast atom beam source of the present invention is further provided with various high-voltage power supplies such as an accelerating power supply for setting the ion at a predetermined accelerating voltage, a heater power supply for heating the heater 1*a*, an extraction power supply for emitting the ion beam and retaining a prescribed emission current, and a lens power supply capable of controlling a voltage applied to the objective lens, all of which are not shown in the drawings.

The source size of the ions emitted from the liquid metal ion source 1 is known to have a size of several tens of nanometers. Therefore, even if it is projected with identical magnification(X1) through an electrostatic lens, an ion beam having a diameter of approximately 50 nm can still be obtained. The ion beam, after being controlled in an ion current by the condenser lens 3, is focused on the sample placed on the sample stage 11, and is neutralized by the neutralizer 10 to generate a fast atom beam of a submicron order.

Figure 2:
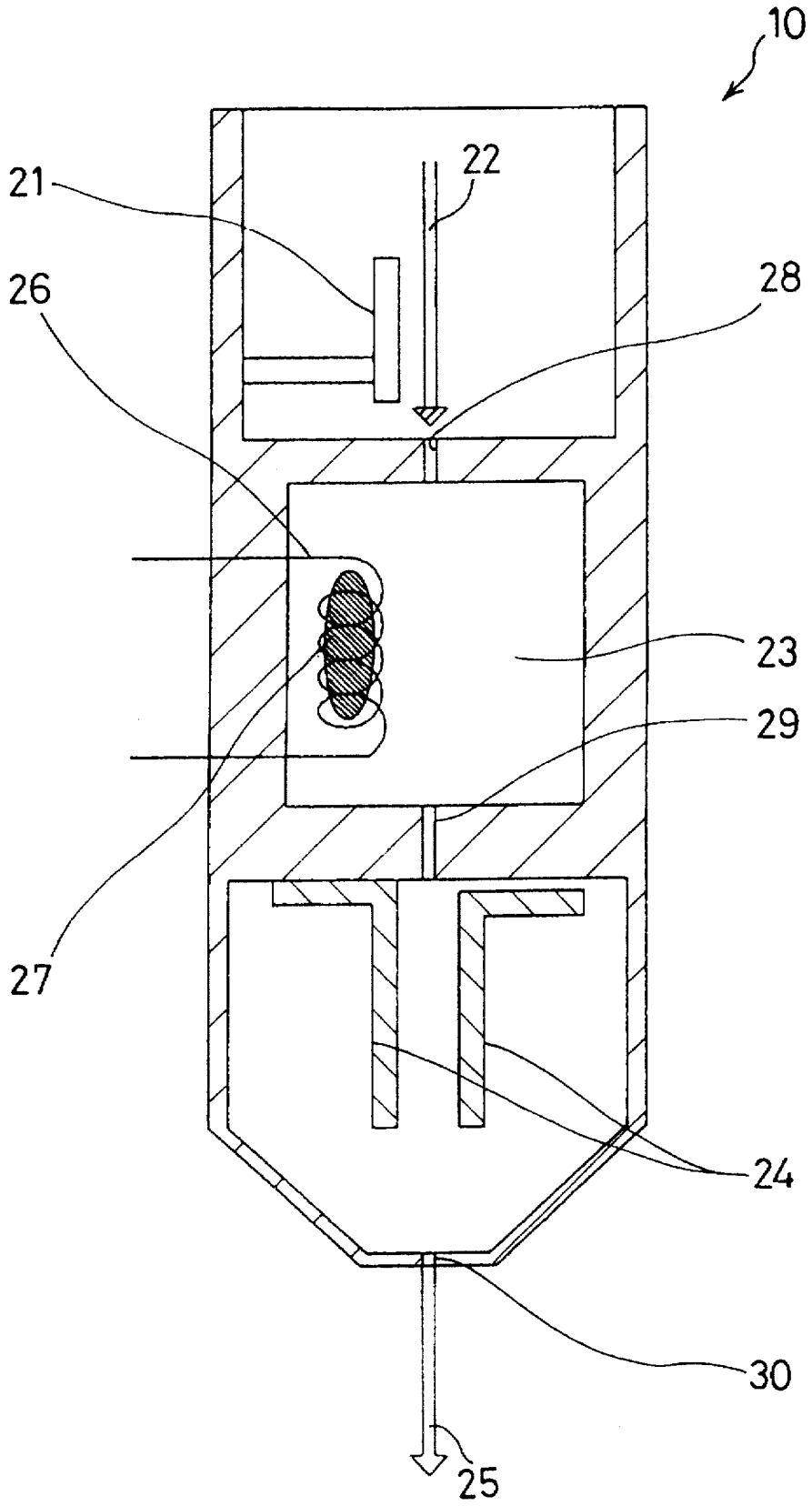
FIG. 2 is an enlarged view showing a neutralizer shown in FIG. 1.

FIG. 2 shows an example of the neutralizer 10. The neutralizer 10 has a neutralizing chamber 23 on the path of the ion beam (22). In the neutralizing chamber 23 is formed an upper orifice 28 and a lower orifice 29, which are connected to a vacuum system having a turbo-molecule pump, for example, so that the neutralizing chamber is under differential pumping to maintain the internal pressure thereof at about $10^{-3}$ Torr. The neutralizer 10 has a deflection electrode 21 for introducing the beam to the upper and lower orifices 28, 29 by adjusting an axis of the beam with an electric field. The upper and lower orifices 28, 29 act as an entrance of the ion beam and an exit of the electrically neutral fast atom beam as well as evacuation paths. In the neutralizing chamber 23, a heater 26 shaped in a coil is provided for heating and vaporizing, as well as for holding, a liquid metal 27 which is identical to the metal element of the ion source 1. The pressure of the metal vapor is adjusted to the order of $10^{-3}$ Torr by differential pumping. At the exit of the neutralizing chamber 23, a deflection electrode 24 is provided for removing residual ions in the fast atom beam with an electric field.

The above-described fast atom beam source operates as follows. A predetermined voltage is applied to the liquid metal ion source 1 by the accelerating power supply, and then the heater 1*a* is heated by the heater power supply to heat the liquid metal above the melting point thereof. Then, when a high-voltage of 3–7 KV is applied to the extraction electrode 2 by the extraction power supply, a conically-shaped liquid metal having an apex angle of 98.6° called "Taylor corn" grows at the apex of a needle anode which has a radius of 5–10 μm. From the apex of the Taylor corn, the metal ions are emitted as a beam to a vacuum due to a field emission effect. The emitted metal ion beam 22 is focused and deflected by a control electrode of an ion optical system provided above the neutralizer 10, and then is introduced to the upper orifice 28 of the neutralizing chamber 23 after the axis is adjusted by an electric field of X-Y deflection electrodes 21. The neutralizer 10 includes four deflection electrodes 21 one of which is shown in the drawings.

The ion beam introduced into the neutralizing chamber 23 through the upper orifice 28 is brought into contact with a vapor of the metal 27, generated by being heated above a vaporization temperature by the heater 26. The ions of the ion beam are neutralized into electrically neutral atoms through charge exchange reaction between the metal vapor atoms without losing their energy. Since amount of the kinetic energy of the ions is not altered extensively through the contact with the metal vapor, and loss of the kinetic energy of the ions is negligible, the kinetic energy held by the ion beam is inherited by the atom beam without loss, and thus the atoms having a large amount of kinetic energy are generated.

When the accelerating voltage is set at 20 KV, the kinetic energy of the ions will be approximately 20 KeV, and thus, the kinetic energy of the generated fast atoms becomes approximately 20 KeV. The fast atoms generated in the above-described manner are emitted as a beam from the lower orifice 29. Unneutralized ions contained in the emitted fast atom beam are removed by the deflection electrode 24 provided beneath a 0.5 mm ϕ lower orifice 29, and finally the fast atom beam 25 of a submicron order is emitted from the lower orifice 30 of the cover for removing ions having a diameter of 1 mm ϕ, and are irradiated to the sample.

By changing the focusing condition of the condenser lens 3 and the objective lens 8, the fast atom beam can be adjusted in its spot size and beam current, thereby focusing the beam to have the same diameter as the ion beam. By applying a sweep signal to the deflection electrode 9 for sweeping the ion beam along X and Y axes, the fast atom beam can be swept in the same way. Further, by adjusting the accelerating power of the ion beam, the energy of the fast atom beam is set at any desired value.

Further, since the sample is electrically insulated from the sample stage 11, the ion beam current irradiated into the sample, or the amount of a secondary electron or a secondary ion beam emitted from the sample, can be measured. Also, the secondary electron image may be visibly observed by collecting the secondary electrons with the secondary electron multiplier 12 and displaying them on a display in synchronization with the X-Y sweeping signal.

Figure 3:
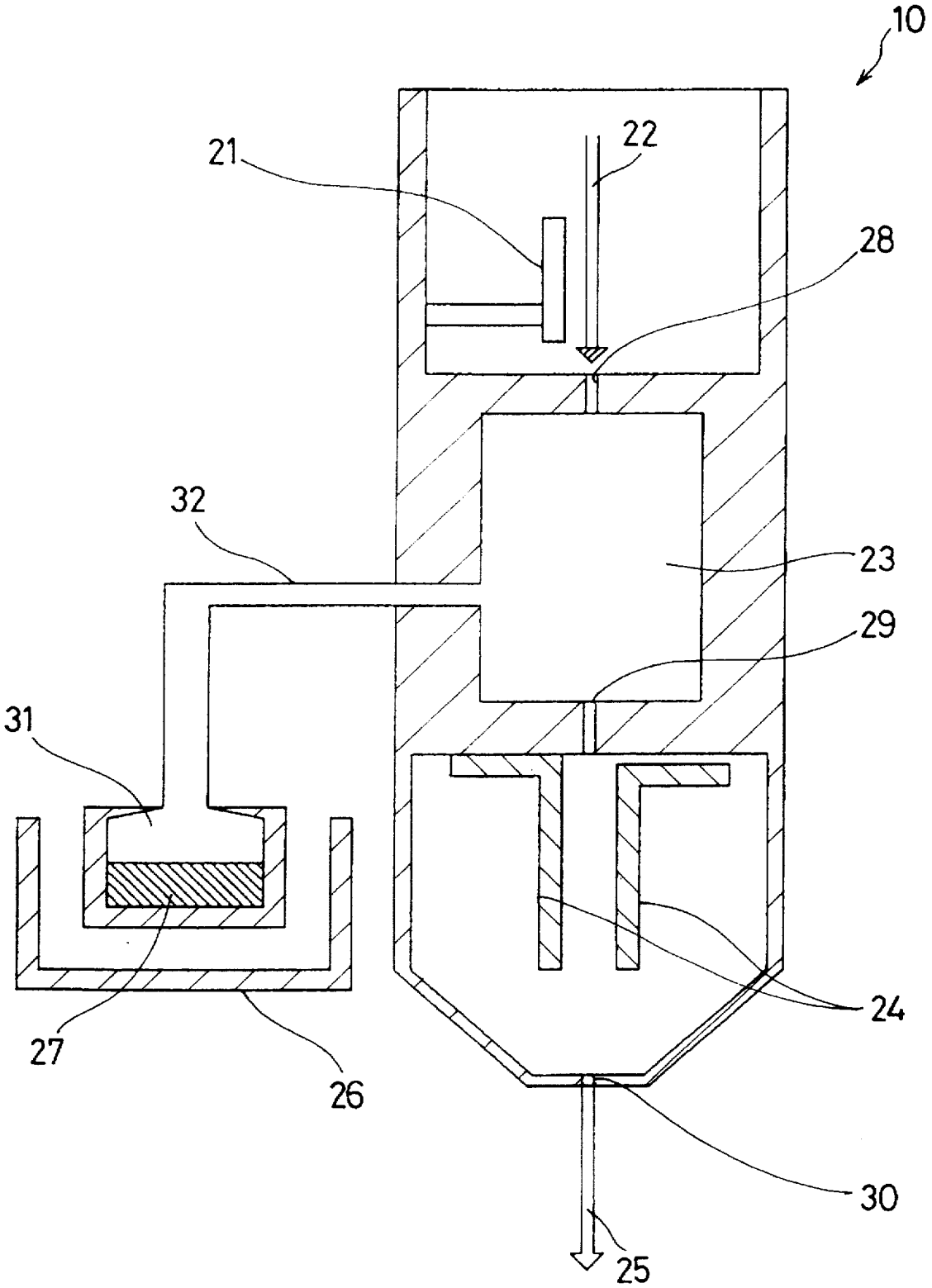
FIG. 3 is an enlarged view showing another neutralizer.

FIG. 3 shows another embodiment of the neutralizer 10. The neutralizer 10 of this embodiment has a crucible 31 provided exterior to the neutralizing chamber 23 connected thereto through pipe 32. The crucible 31 is provided with a heater 26 for heating a gallium metal 27 therein and for supplying it to the neutralizing chamber 31. In this example, since a large amount of gallium metal may be stored in the crucible 31, a gallium metal gas may be stably supplied to the neutralizing chamber 23 for a longer period of time.

Figure 4:
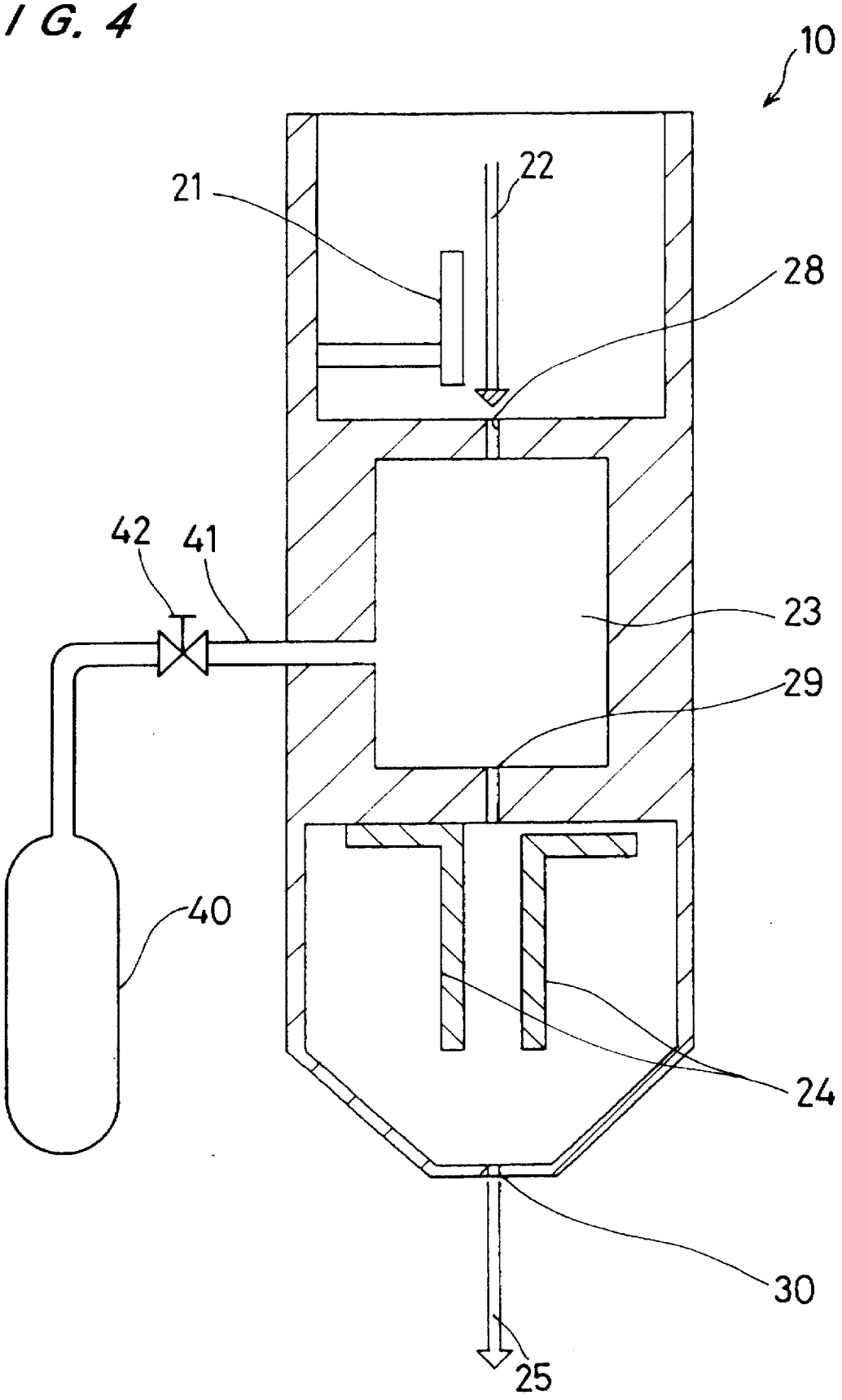
FIG. 4 is an enlarged view showing another neutralizer.

FIG. 4 shows another embodiment of the neutralizer 10. The neutralizer 10 of this embodiment has an organometal gas source 40 connected to the neutralizing chamber 23 through a gas pipe 41 and a valve 42 so that the organometal gas is introduced from the exterior to the vacuum system of the neutralizing chamber 23. According to the neutralizer 10 of this embodiment, the metal gas can be supplied to the neutralizing chamber 23 without breaking the vacuum thereof. Thus, the fast atom beam source may be stably operated for a long period of time without adjustment of the electrooptical system, which becomes necessary due to the breakage of the vacuum.

Although, in the above embodiment, gallium is used as both the ion source metal and the neutralizing metal vapor or organometal gas, a combination of different metals may achieve a similar effect as long as the combination of the ion source and the neutralizing agent improves the efficiency of the neutralization of the ion beam, and the combination disclosed in the specification should not be construed to limit the scope and spirit of the present invention. The inventors have found that, so far as the neutralizing gas comes from the same group as the ion source metal, a high level of efficiency of neutralization of the ion beam can be achieved. In case of using a eutectic alloy as the liquid metal ion source, a vapor of the eutectic alloy can also be used as the neutralizing agent.

Hereinafter, the experimental example of the present invention will be described in order to establish the operation of the fast atom beam source of the present invention.

A wire mesh made of copper (Cu, 400 mesh, Diameter: 25 μm) was placed as a sample on the sample stage 11 of the fast atom beam source shown in FIGS. 1 and 2. A secondary electron image was obtained when a gallium (Ga) fast atom beam was irradiated to the sample. As the comparative example, a secondary electron image was obtained when an ion beam was irradiated to the sample under the same condition.

Figure 5:
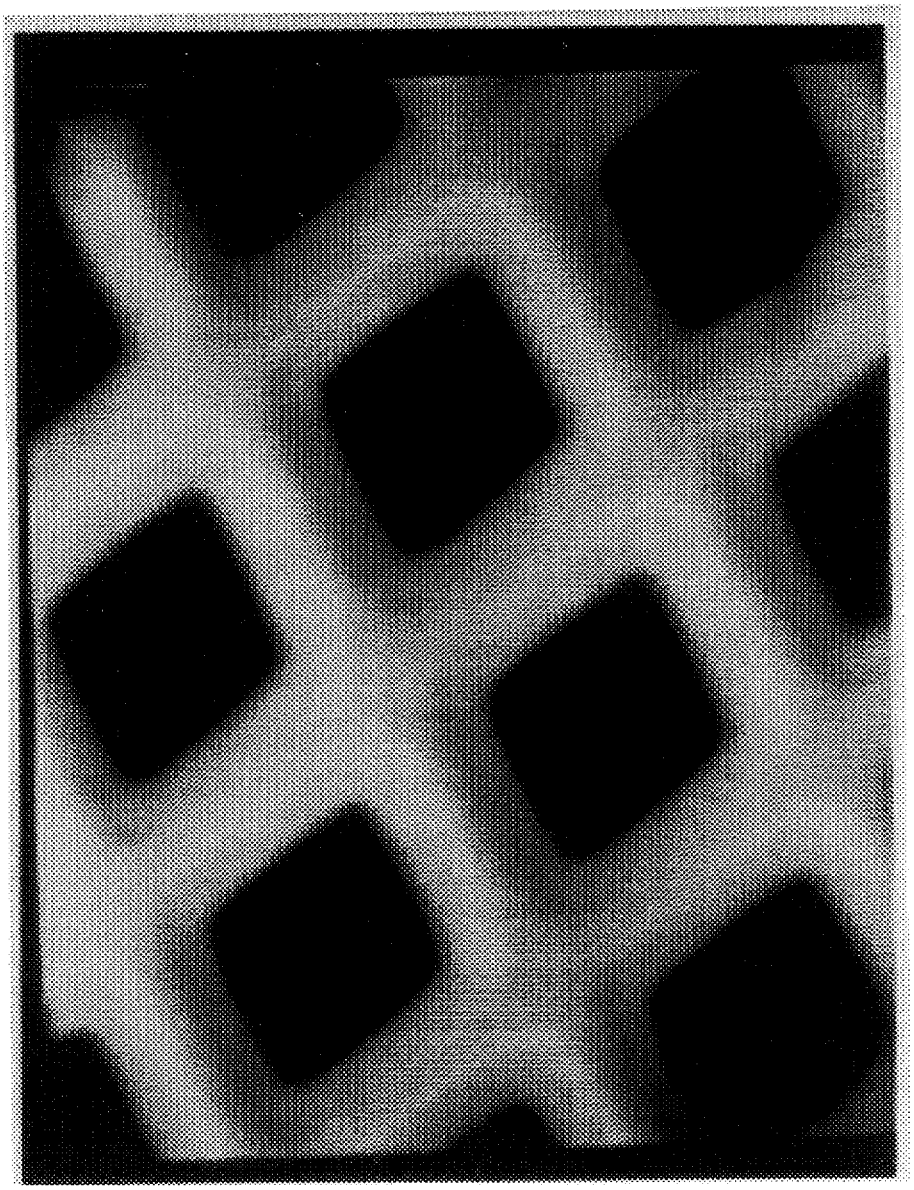
FIG. 5 is a photograph of a secondary electron image of a surface of a metal sample due to a gallium ion beam as a primary beam.

FIG. 5 shows a secondary electron image when the heater 26 of the neutralizing chamber 23 and the deflection electrode 24 for removing the ions were turned off so that the focused ion beam passed the neutralizing chamber 10 without being neutralized.

Figure 6:
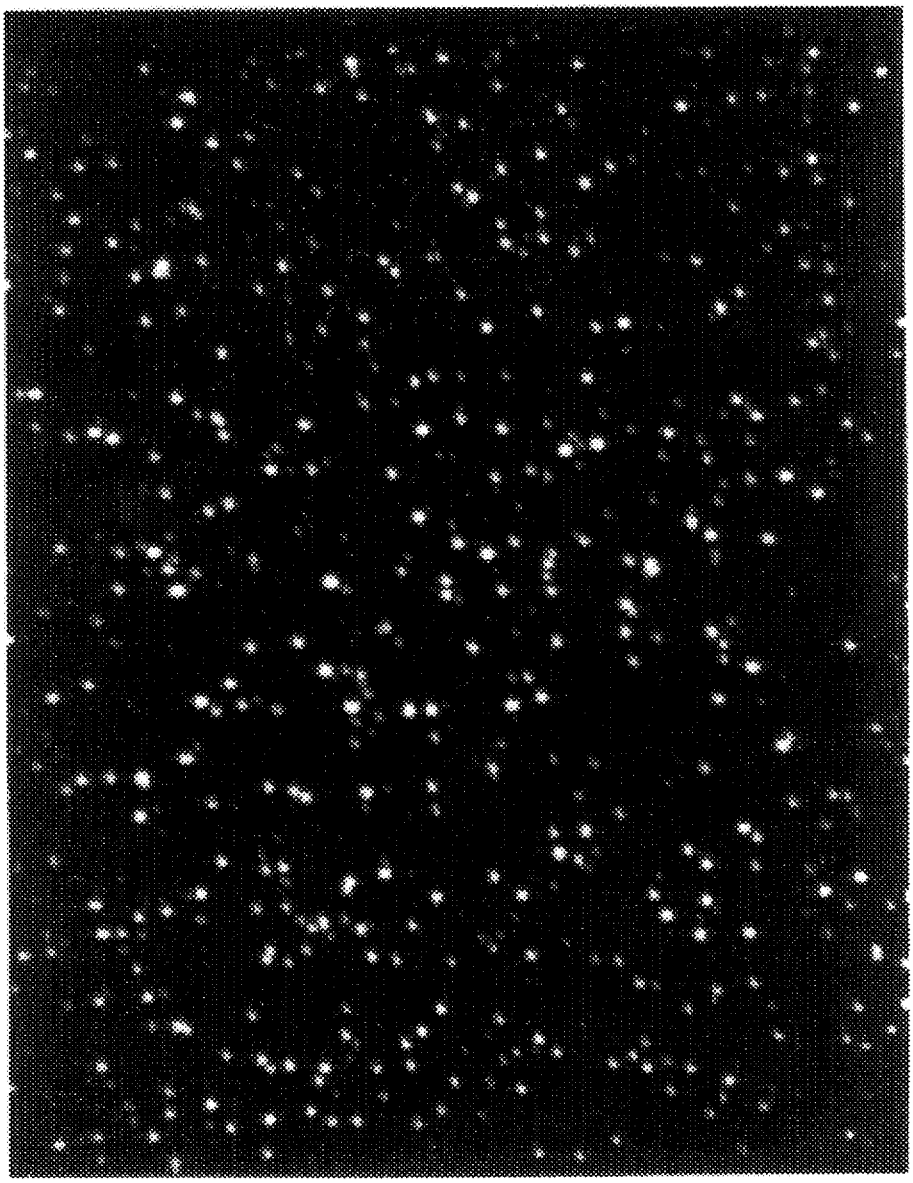
FIG. 6 is a photograph of a secondary electron image when gallium ions are removed from the primary beam.

FIG. 6 shows a secondary electron image when only the deflection electrode for removing the ions was turned on from the state of FIG. 5. Since the ion beam could not pass the lower orifice 30 of the cover for removing the ions due to the operation of the deflection electrode 24, the image of the secondary electron did not appear.

Figure 7:
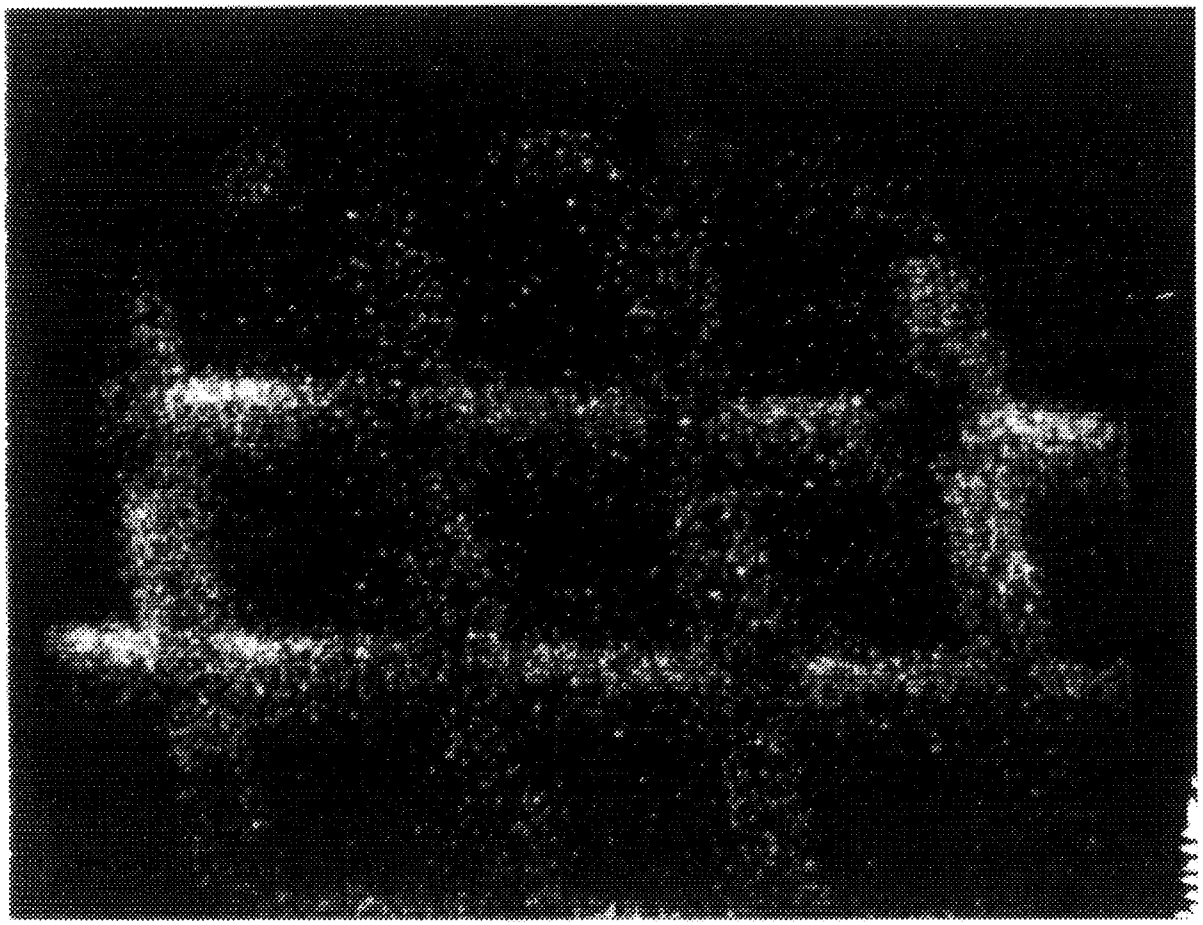
FIG. 7 is a photograph of a secondary electron image of the surface of the metal sample due to a gallium fast atom beam when an electric current of a heater in a neutralizing. chamber is 2.0 A.
Figure 8:
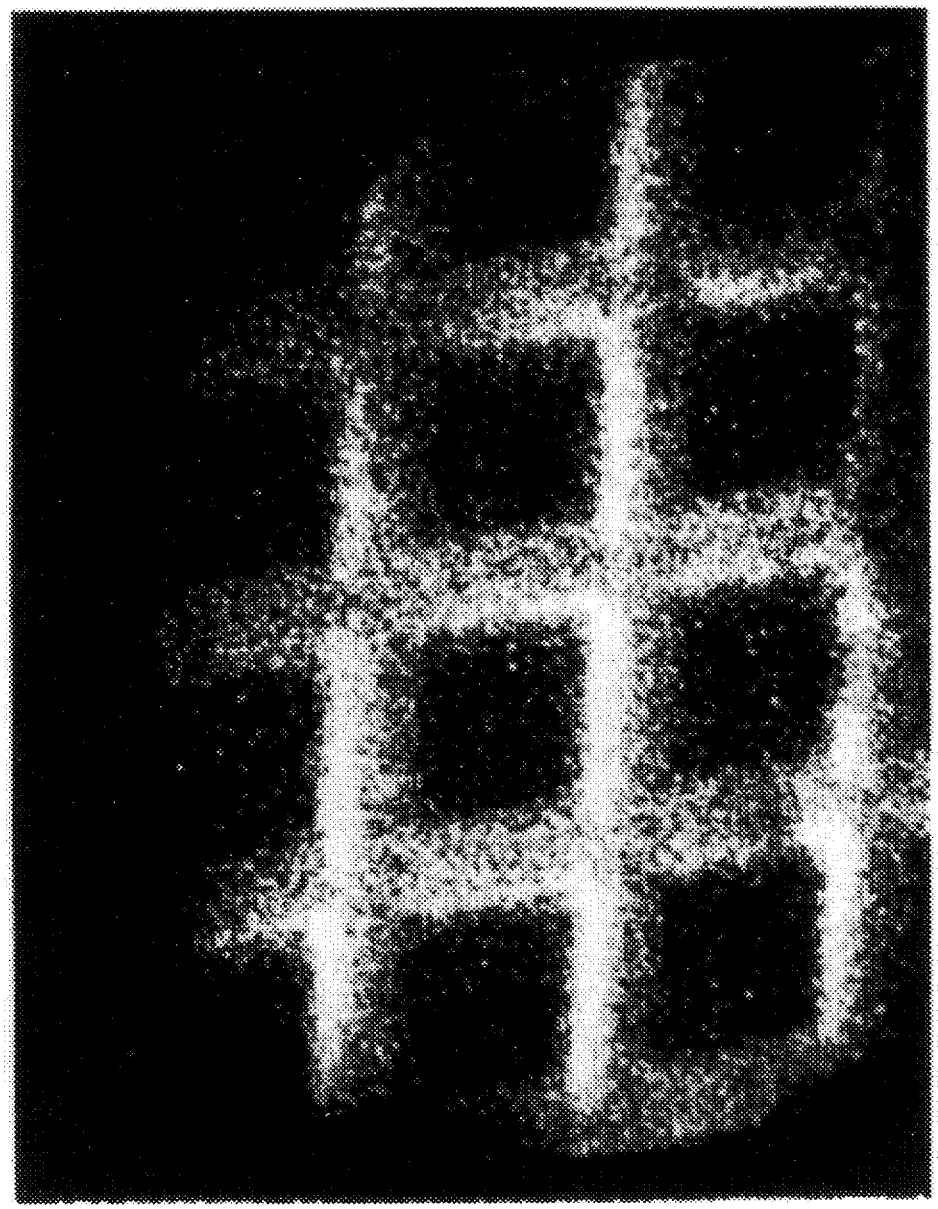
FIG. 8 is a photograph of a secondary electron image of the surface of the metal sample due to the gallium fast atom beam when an electric current of the heater in the neutralizing chamber is 2.2 A.

FIGS. 7 and 8 show a secondary electron image when the heater 26 of the neutralizing chamber 23 was turned on after the images of FIGS. 5 and 6 were observed. The ions were neutralized before they reached the deflection electrode 24. Since the neutralized beam was irradiated to the sample without the influence of the deflection electrode 24, the image of the secondary electron was observed. In FIG. 7, the current of the heater is 2.0 A, and in FIG. 8, 2.2 A. FIGS. 7 and 8 show a change in the secondary electron image due to an increase of the pressure of the gallium metal vapor.

Figure 9:
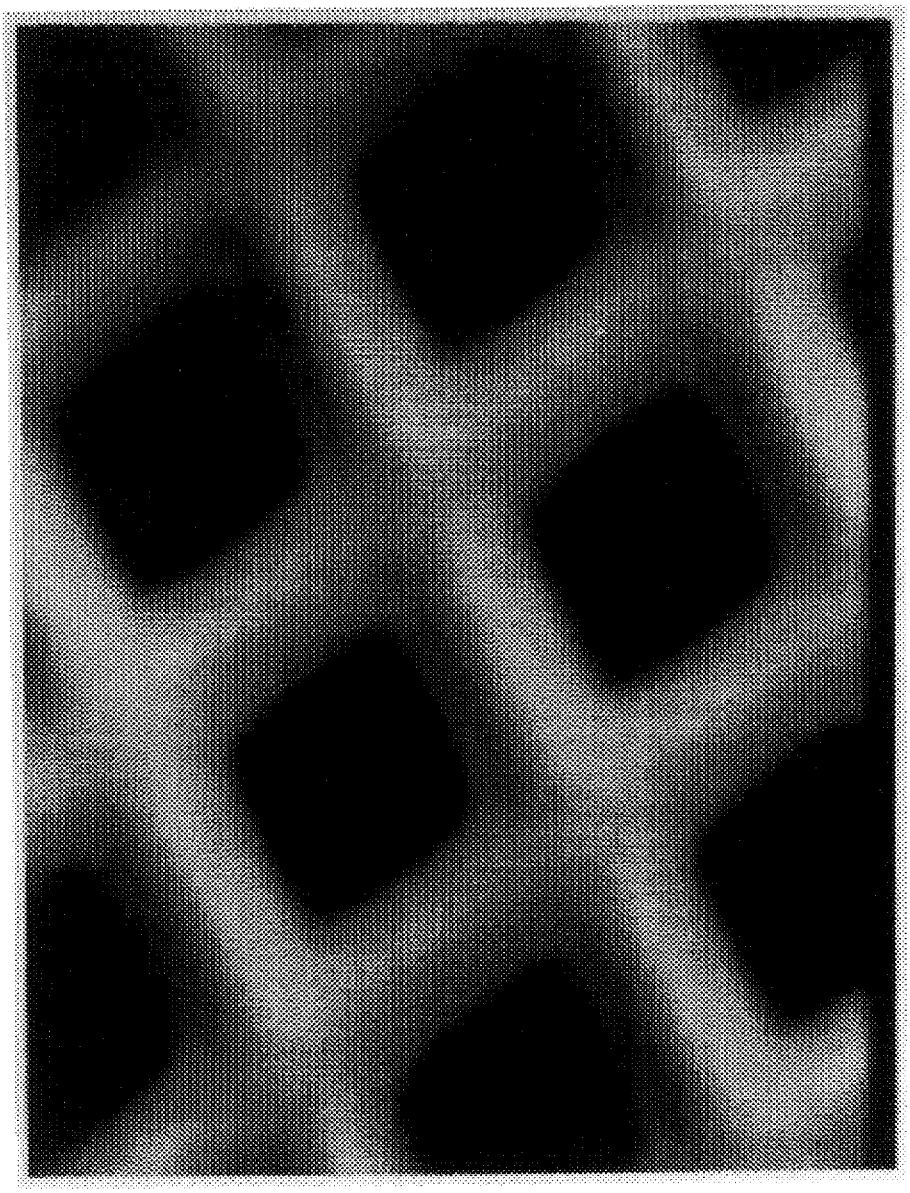
FIG. 9 is a photograph of a secondary electron image of the surface of the metal sample due to the gallium fast atom beam when an electric current of the heater in the neutralizing chamber is 3.5 A.

FIG. 9 is a photograph of a secondary electron image of the gallium fast atom beam when the current of the heater was set at 3.5 A. It can be seen that, when compared with the secondary electron image due to the gallium ion beam shown in FIG. 5, the image in FIG. 9 has a substantially equivalent resolution. This means that the neutralizer 10 efficiently neutralized the small diameter ion beam to generate a fast atom beam having a high serviceability with an equivalent performance with an ion beam as an energy beam.

As is apparent from the above description, according to a fast atom beam source of the present invention, the fast atom beam having a small diameter can be provided by efficiently neutralizing an ion beam having a small diameter in the neutralizing chamber containing a metal gas. The use of the fast atom beam of the present invention has made it possible to precisely analyze insulator materials such as ceramics, plastics and organic compounds, thereby exhibiting a high potency in characterizing various materials. Further, when the fast atom beam is used as a primary beam for use in a microprocessing or microfabrication, insulators such as ceramics, plastics and organic compounds, and biological tissues, which have been difficult to process, can be easily processed at a submicron order.

Although certain preferred embodiments of the present invention have been shown and described in detail, it should be understood that various changes and modifications may be made therein without departing from the scope of the appended claims.

What is claimed is:

1. A fast atom beam source for generating an electrically neutral fast atom beam comprising:

a metal ion beam generating means for ionizing a liquid metal and generating a metal ion beam having a diameter less than 1 μm and a flux along a path;

a control electrode system for controlling the flux of the metal ion beam;

a neutralizing chamber disposed in the path of the flux for neutralizing the ions in the flux to generate a fast atom beam; and a neutralizing gas supply means for supplying a neutralizing gas containing a metal element into said neutralizing chamber.

2. A fast atom beam source according to claim 1, wherein said metal element contained in said neutralizing gas is of the same group as the element included in said liquid metal.

3. A fast atom beam source according to claim 1, wherein said metal element contained in said neutralizing gas is the same element as the element included in said liquid metal.

4. A fast atom beam source according to claim 1, wherein said neutralizing gas contains a metal vapor.

5. A fast atom beam source according to claim 1, wherein said neutralizing gas contains an organometal vapor.

6. A fast atom beam source according to claim 1, further comprising a deflection electrode for removing residual ions remaining in the fast atom beam.

7. A microprocessing apparatus for processing microsized structure on a workpiece comprising:

a metal ion beam generating means for ionizing a liquid metal and generating a metal ion beam having a diameter less then 1 μm and a flux along a path;

a control electrode system for controlling the flux of the metal ion beam;

a neutralizing chamber disposed in the path of the flux for neutralizing the ions in the flux to generate a fast atom beam; and a neutralizing gas supply means for supplying a neutralizing gas containing a metal element into said neutralizing chamber.

8. A microprocessing apparatus according to claim 7, wherein said metal element contained in said neutralizing gas is of the same group as the element included in said liquid metal.

9. A microprocessing apparatus according to claim 7, wherein said metal element contained in said neutralizing gas is the same element as the element included in said liquid metal.

10. A microprocessing apparatus according to claim 7, wherein said neutralizing gas contains a metal vapor.

11. A microprocessing apparatus according to claim 7, wherein said neutralizing gas contains an organometal vapor.

12. A microprocessing apparatus according to claim 7, further comprising a deflection electrode for removing residual ions remaining in the fast atom beam.

13. A microanalyzer for analyzing materials such as insulators comprising:

a metal ion beam generating means for ionizing a liquid metal and generating a metal ion beam having a diameter less than 1 μm and a flux along a path;

a control electrode system for controlling the flux of the metal ion beam;

a neutralizing chamber disposed in the path of the flux for neutralizing the ions in the flux to generate a fast atom beam;

neutralizing gas supply means for supplying a neutralizing gas containing a metal element into said neutralizing chamber;

a sample holding device for holding a sample in the path of said fast atom beam; and a secondary emission detecting device for defecting a secondary emission emitted from said sample when said fast atom beam is irradiated to said sample.

14. A microanalyzer according to claim 13, wherein said metal element contained in said neutralizing gas is of the same group as the element included in said liquid metal.

15. A microanalyzer according to claim 13, wherein said metal element contained in said neutralizing gas is the same element as the element included in said liquid metal.

16. A microanalyzer according to claim 13, wherein said neutralizing gas contains a metal vapor.

17. A microanalyzer according to claim 13, wherein said neutralizing gas contains an organometal vapor.

18. A microanalyzer according to claim 13, further comprising a deflection electrode for removing residual ions remaining in the fast atom beam.

19. A microanalyzer according to claim 13, wherein said secondary emission detecting device comprises a secondary electron image obtaining device for obtaining an image of a secondary electron emitted from said sample.

20. A method of generating an electrically neutral fast atom beam comprising the steps of:

ionizing a liquid metal generating a metal ion beam having a diameter less than 1 μm and a flux along a path;

controlling the flux of the metal ion beam with a control electrode system; and neutralizing the ions in the flux with a neutralizing chamber disposed in the path of the flux by supplying a neutralizing gas containing a metal element into the neutralizing chamber from a neutralizing gas supply to generate a fast atom beam.

21. The method of claim 20, wherein said step of neutralizing further comprises having the metal element of the neutralizing gas be of the same group as an element included in the liquid metal.

22. The method of claim 20, wherein said step of neutralizing further comprises having the metal element of the neutralizing gas be the same as an element included in the liquid metal.

23. The method of claim 20, wherein said step of neutralizing further comprises having the neutralizing gas contain a metal vapor.

24. The method of claim 20, wherein said step of neutralizing further comprises having the neutralizing gas contain an organometal vapor.

25. The method of claim 20, and further comprising the step of removing residual ions remaining in the fast atom beam with a deflection electrode.

26. A method of processing microsized structure on a workpiece comprising the steps of:

ionizing a liquid metal to generate metal ions and generating a metal ion beam having a diameter less then 1 μm and a flux along a path;

controlling the flux of the metal ion beam with a control electrode system; and neutralizing the ions in the flux with a neutralizing chamber disposed in the path of the flux by supplying a neutralizing gas containing a metal element from a neutralizing gas supply into the neutralizing chamber to generate a fast atom beam.

27. The method of claim 26, wherein said step of neutralizing further comprises having the metal element of the neutralizing gas be of the same group as an element included in the liquid metal.

28. The method of claim 26, wherein said step of neutralizing further comprises having the metal element of the neutralizing gas be the same as an element included in the liquid metal.

29. The method of claim 26, wherein said step of neutralizing further comprises having the neutralizing gas contain a metal vapor.

30. The method of claim 26, wherein said step of neutralizing further comprises having the neutralizing gas contain an organometal vapor.

31. The method of claim 26, and further comprising the step of removing residual ions remaining in the fast atom beam with a deflection electrode.

32. A method of microanalyzing materials such as insulators comprising the steps of:

ionizing a liquid metal and generating a metal ion beam having a diameter less than 1 μm and a flux along a path;

controlling the flux of the metal ion beam with a control electrode system;

neutralizing the ions in the flux with a neutralizing chamber disposed in the path of the flux by supplying a neutralizing gas containing a metal element from a neutralizing gas supply into the neutralizing chamber to generate a fast atom beam;

holding a sample in the path of the fast atom beam with a sample holding device; and detecting a secondary emission emitted from the sample with a secondary emission detecting device when the fast atom beam is irradiated to the sample.

33. The method of claim 32, wherein said step of neutralizing further comprises having the metal element of the neutralizing gas be of the same group as an element included in the liquid metal.

34. The method of claim 32, wherein said step of neutralizing further comprises having the metal element of the neutralizing gas be the same as an element included in the liquid metal.

35. The method of claim 32, wherein said step of neutralizing further comprises having the neutralizing gas contain a metal vapor.

36. The method of claim 32, wherein said step of neutralizing further comprises having the neutralizing gas contain an organometal vapor.

37. The method of claim 32, and further comprising the step of removing residual ions remaining in the fast atom beam with a deflection electrode.

38. The method of claim 32, wherein said step of detecting a secondary emission comprises obtaining an image of secondary electrons emitted from the sample with a secondary electron image obtaining device.

* * * * *